US005313676A

United States Patent [19]

Wright

[11] Patent Number: 5,313,676

[45] Date of Patent: May 24, 1994

[54] SPORTSMAN SINK APPARATUS

[76] Inventor: Micheal W. Wright, 13168 W. 88th St. Court Apts. 193, Lenexa, Kans. 66215

[21] Appl. No.: 27,422

[22] Filed: Mar. 8, 1993

[51] Int. Cl.[5] ..... A47K 1/05

[52] U.S. Cl. ..... 4/645; 4/631; 4/638

[58] Field of Search ..... 4/625, 626, 630, 631, 4/638, 643, 645, 656, 657; 108/69, 131

[56] References Cited

U.S. PATENT DOCUMENTS

| | | | |
|---|---|---|---|
| 484,723 | 10/1892 | Phillips | 108/80 |
| 1,366,910 | 2/1921 | Hegrat | 4/630 |
| 2,393,598 | 1/1946 | Dyett et al. | 108/77 X |
| 2,421,808 | 6/1947 | Robertson | 4/657 |
| 2,594,938 | 4/1952 | Leavitt | 4/638 X |
| 3,594,830 | 7/1971 | Clifton | 4/625 |
| 4,766,621 | 8/1988 | Rasor | 4/638 X |

*Primary Examiner*—Charles E. Phillips
*Attorney, Agent, or Firm*—Leon Gilden

[57] ABSTRACT

A sportsman sink having foldable legs is arranged to include a pump member to receive water from available water supplies and direct such water through a faucet to an underlying sink. The table is arranged for interfolding of the legs and a wing plate for ease of positioning the table relative to an underlying support surface.

3 Claims, 4 Drawing Sheets

FIG 1
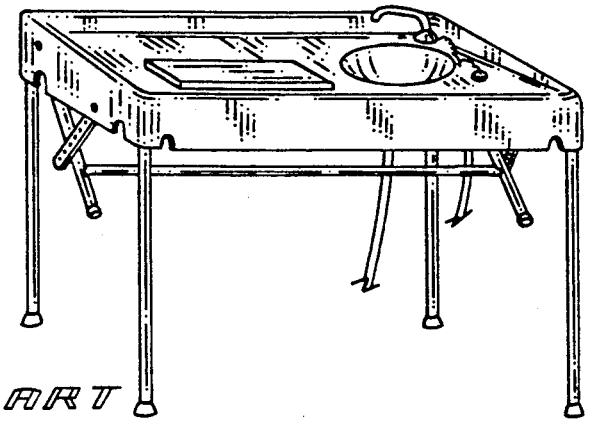
PRIOR ART
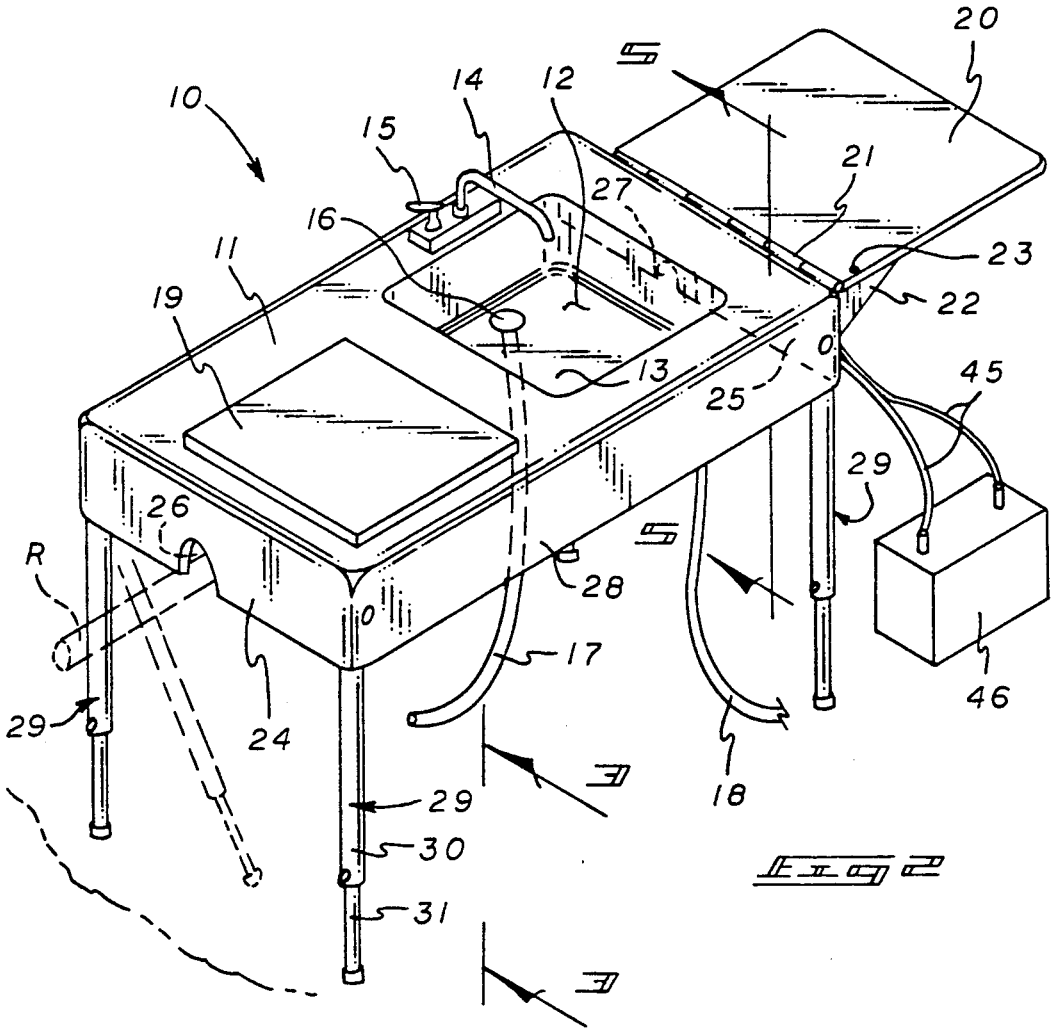
FIG 2

SPORTSMAN SINK APPARATUS

BACKGROUND OF THE INVENTION

1. Field of the Invention

The field of invention relates to table apparatus, and more particularly pertains to a new and improved sportsman sink apparatus wherein the same is arranged for ease of storage, as well as for positioning relative to various support surfaces.

2. Description of the Prior Art

Sink structure of various types have been utilized throughout the prior art for portable positioning in a manner as indicated in U.S. Pat. No. 4,766,621; U.S. Pat. No. 4,747,169; and U.S. Pat. No. 3,594,830.

The instant invention attempts to overcome deficiencies of the prior art by providing for a sink structure including a portable battery supply to permit ease of pumping of water through an associated faucet structure and in this respect, the present invention substantially fulfills this need.

SUMMARY OF THE INVENTION

In view of the foregoing disadvantages inherent in the known types of sink apparatus now present in the prior art, the present invention provides a sportsman sink apparatus wherein the same is arranged for folding of the legs to support the sink structure relative to various support surfaces. As such, the general purpose of the present invention, which will be described subsequently in greater detail, is to provide a new and improved sportsman sink apparatus which has all the advantages of the prior art sink apparatus and none of the disadvantages.

To attain this, the present invention provides a sportsman sink having foldable legs arranged to include a pump member to receive water from available water supplies and direct such water through a faucet to an underlying sink. The table is arranged for interfolding of the legs and a wing plate for ease of positioning the table relative to an underlying support surface.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved sportsman sink apparatus which has all the advantages of the prior art sink apparatus and none of the disadvantages.

It is another object of the present invention to provide a new and improved sportsman sink apparatus which may be easily and efficiently manufactured and marketed.

It is a further object of the present invention to provide a new and improved sportsman sink apparatus which is of a durable and reliable construction.

An even further object of the present invention is to provide a new and improved sportsman sink apparatus which is susceptible of a low cost of manufacture with regard to both materials and labor, and which accordingly is then susceptible of low prices of sale to the consuming public, thereby making such sportsman sink apparatus economically available to the buying public.

Still yet another object of the present invention is to provide a new and improved sportsman sink apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the prior art structure, as indicated in U.S. Pat. No. 4,766,621, having a fisherman's sink structure utilizing foldable legs.

FIG.2 is an isometric illustration of the invention.

DESCRIPTION OF THE PREFERRED EMBODIMENT

Figure 3:
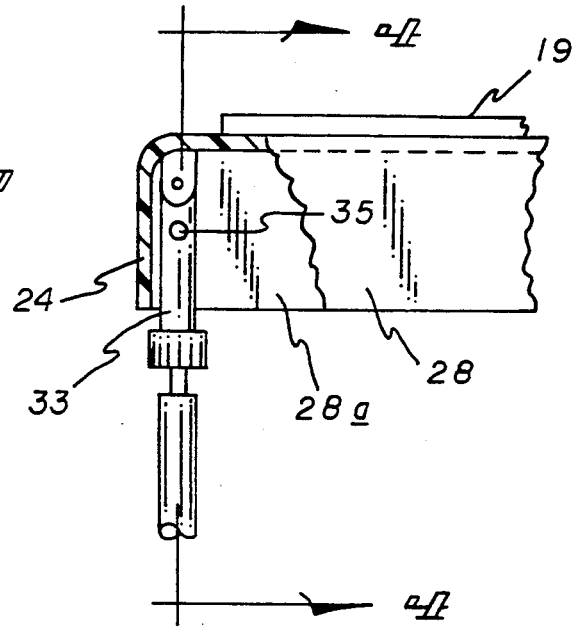
FIG. 3 is an orthographic view, taken along the lines 3—3 of FIG. 2 in the direction indicated by the arrows.

With reference now to the drawings, and in particular to FIGS. 1 to 8 thereof, a new and improved sportsman sink apparatus embodying the principles and concepts of the present invention and generally designated by the reference numeral 10 will be described.

More specifically, the sportsman sink apparatus 10 of the instant invention essentially comprises a table plate 11 having a sink cavity 12 directed into the table plate 11. The sink cavity 12 includes a cavity floor 13 having a faucet 14 extending over the sink cavity 12, with the faucet including a faucet valve 15 to selectively direct fluid flow through the faucet 14 into the sink cavity 12. A drain opening 16 is directed through the cavity floor 13 operative through a drain opening conduit 17 to direct fluid from the sink cavity 12.

A fill conduit 18 is in fluid communication with the faucet 14 through a pump 41 (see FIG. 5), and a pump conduit 42 directed from the pump 41 to the faucet 14.

A resilient mat 19 is mounted on the table plate 11 in adjacency to the sink cavity 12 for positioning various components thereon in a non-slip relationship. An extension plate 20 is hingedly mounted to the table plate 11 by a hinge 21 utilizing a support web 22 pivotal about a web axle 23 that in turn is directed through the extension plate 22 to provide for support to the extension plate 20 in a coplanar relationship relative to the table plate 11 in a first position, wherein rotation of the support web 22 displaces the support web permitting folding of the extension plate 20 along the table plate in a second orthogonal relationship. A skirt is continuously mounted about the table plate 11 extending downwardly therefrom, having a first side wall 24 spaced from a second side wall 25, wherein the first side walls 24 and 25 include respective first and second openings 26 and 27 directed into the first and second side walls 24 and 25 from the lowermost edges, with the first and second side wall openings 26 and 27 aligned relative to one another spaced an equal distance relative to the front wall 28, wherein the first and second side walls are arranged to receive a ship's rail "R", in a manner as indicated in FIG. 2, for stability to the organization. A rear wall **28*a* (see FIG. 3) forms the portion of the skirt in a spaced relationship relative to the front wall 28**.

Figure 4:
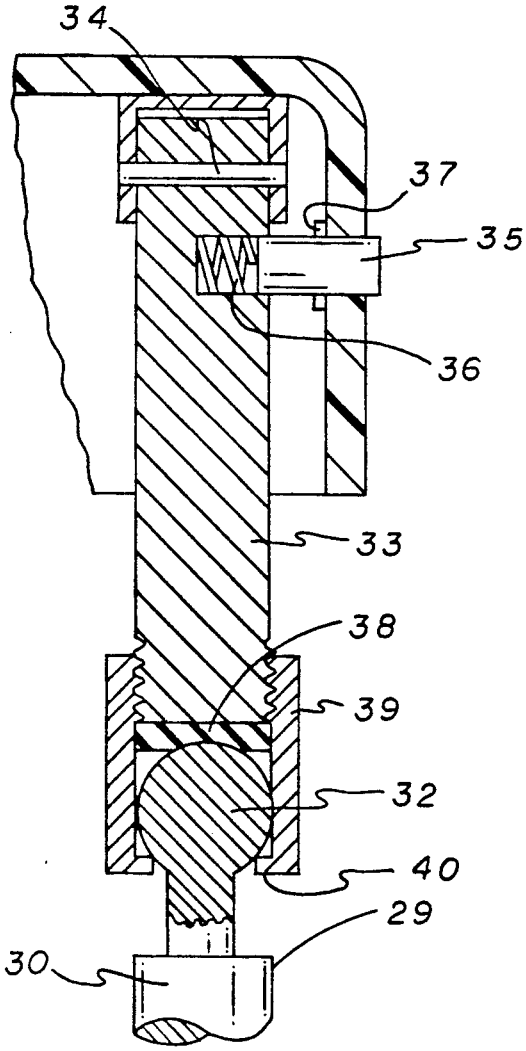
FIG. 4 is an orthographic view, taken along the lines 4—4 of FIG. 3 in the direction indicated by the arrows.
Figure 5:
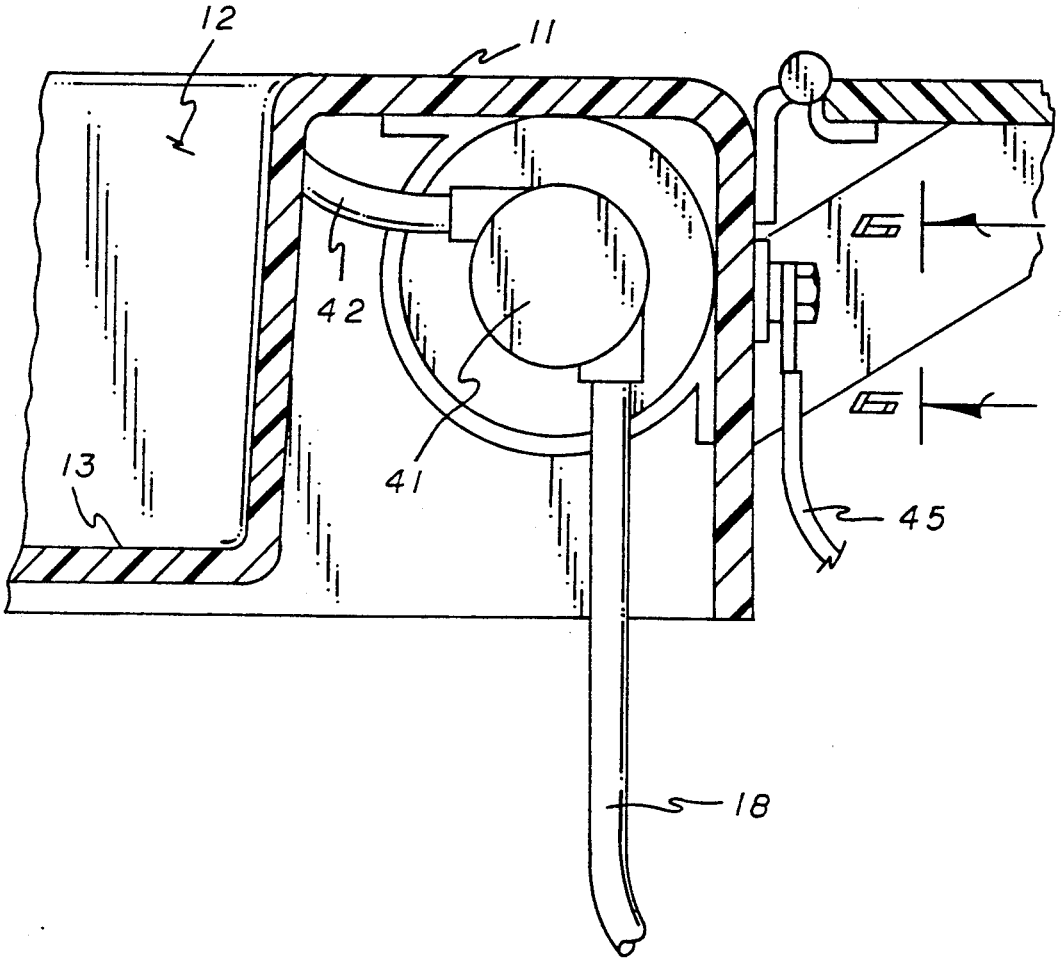
FIG. 5 is an orthographic view, taken along the lines 5—5 of FIG. 2 in the direction indicated by the arrows.
Figure 6:
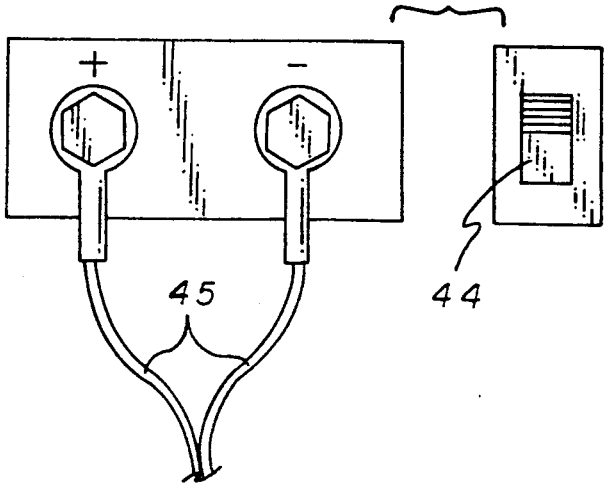
FIG. 6 is an orthographic view, taken along the lines 6—6 of FIG. 5 in the direction indicated by the arrows.

Intersection of the first and second side walls 24 and 25 relative to the respective front and rear walls 28 and **28*a* respectively provid for a support leg 29 mounted to each thusly formed corner of therefore the skirt relative to each corner portion of the table plate 11. Each of the support legs 29 includes a first tube 30 telescopingly receiving a second tube 31. A first tube spherical head 32 is mounted to the first tube 30 and positioned in coaxial alignment with a support rod 33 that in turn is pivotally mounted about a pivot axle 34 to a bottom surface of the table plate 11. A latch rod 35 is orthogonally directed into the support rod 33, with the latch rod 35 having a rod spring 36 captured between the latch rod and the support rod biasing the latch rod in a spaced relationship relative to the support rod for reception through an associated skirt aperture 35*a* to receive the latch rod therethrough when the latch rod is aligned with the latch rod aperture and the support rod 33 is orthogonally oriented relative to the table plate 11, as illustrated in FIG. 4. A latch rod abutment 37 to the latch rod 35 below the table plate 11 and mounted is positioned such that a latch rod abutment 37 prevents projection of the latch rod through the latch rod aperture. A resilient friction pad 38 is fixedly mounted to a free distal end of the support rod 33 in communication with the spherical head 32, wherein a lock sleeve 39 threadedly mounted about the free end of the support rod 33 includes a lock sleeve flange 40 capturing the spherical head between the lock sleeve flange 40 and the friction pas 38 to assist in biased alignment of the spherical head and the associated first and second tubes 30 and 31 relative to the support rod 33**.

As illustrated in the FIGS. 2–6, a battery 46 is provided, having battery cables 45 directed through on/off switch 44 into electrical communication with the pump 41 to provide for selective actuation of the pump 41 in use.

Figure 7:
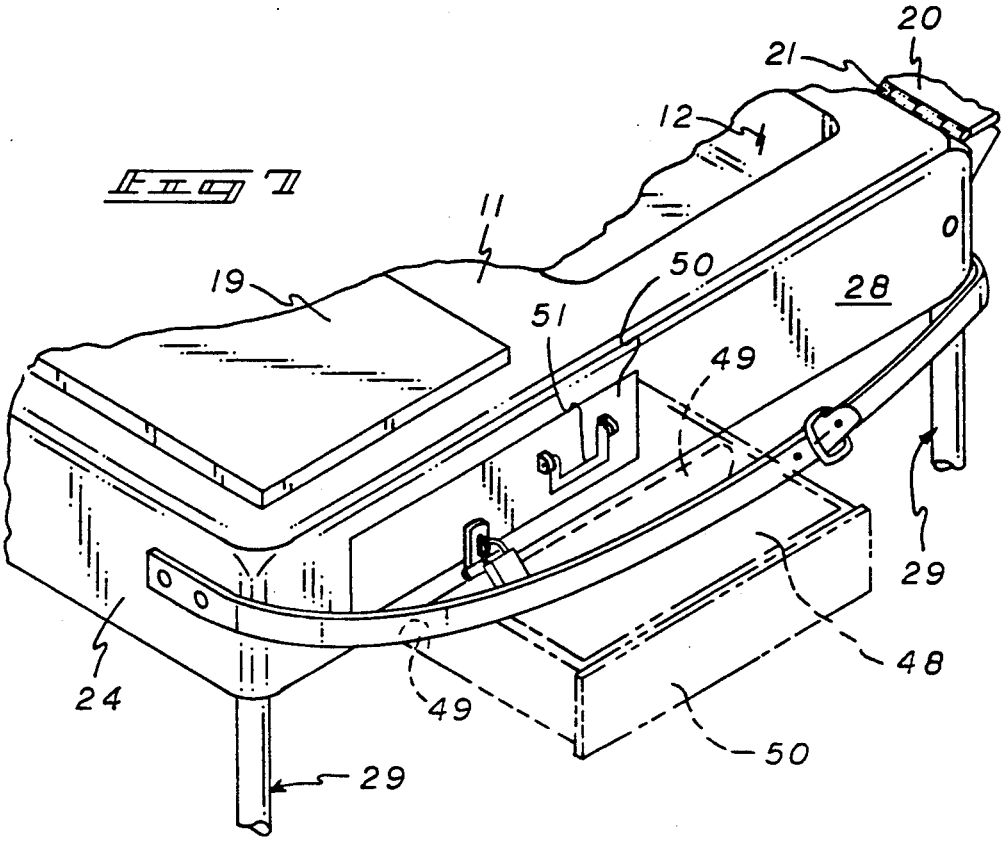
FIG. 7 is an isometric illustration of the sink structure employing a slide drawer directed through a front wall thereof.
Figure 8:
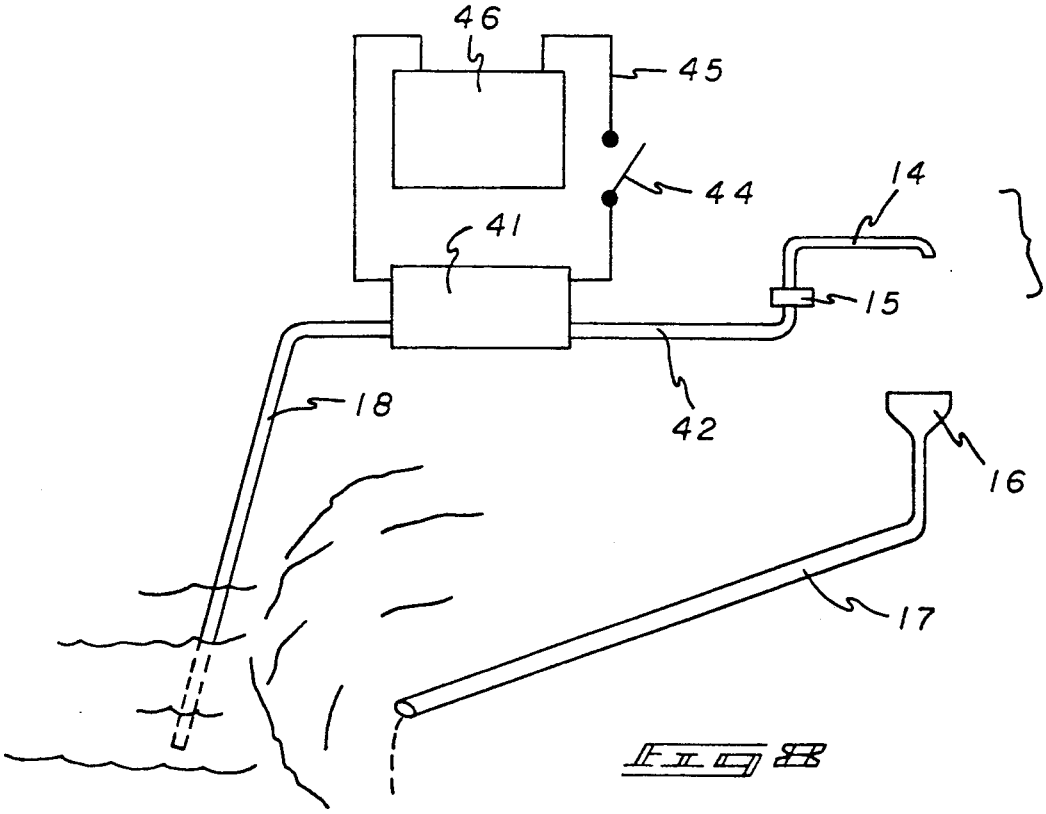
FIG. 8 is a diagrammatic illustration of the pump structure relative to the fluid conduit of the sink organization.

A slide drawer 47 is illustrated in FIG. 7 slidably directed through the front wall 28, having a slide drawer handle 51 and a slide drawer floor 48. The slide drawer floor 48 includes a floor tunnel 49 directed into the floor 48, with the floor tunnel 49 arranged for alignment in a coaxially aligned relationship relative to the first and second openings 26 and 27 to assist in locking the drawer in the retracted position when the drawer front wall 50 is in a coplanar relationship relative to the skirt front wall 28. As illustrated in FIG. 7, a lock and hasp structure may be employed to secure the drawer in the first position relative to the extended position, as illustrated in phantom in FIG. 7.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A sportsman sink apparatus, comprising, a table plate, the table plate including a sink cavity directed into the table plate, and the sink cavity having a sink cavity floor, and a faucet mounted to the table plate in adjacency to the sink cavity extending over the sink cavity, and the faucet including a faucet valve to selectivity direct fluid flow through the faucet, and the cavity floor having a drain opening, and a flexible drain conduit extending from the opening below the table plate, and a resilient mat member mounted to the table plate in adjacency to the sink cavity for frictional engagement of workpiece components mounted upon the resilient mat, and an extension plate, the extension plate including a hinge to pivotally mount the extension plate to the table plate, and the extension plate includes a support web, the support web having a web axle pivotally mounting the support web to the extension plate to provide for engagement of the support web, and a continuous skirt mounted to the table plate extending downwardly therefrom in an orthogonal relationship, wherein the support web is arranged for selective engagement with the skirt, and the skirt has a first side wall spaced from and parallel a second side wall, the first side wall including a first side wall opening extending into the first side wall from a lowermost edge of the first side wall, and the second side wall including a second side wall opening extending into the second side wall from the lowermost edge of the second side wall, with a first opening and a second opening arranged in a coaxially aligned relationship to receive a rail member therewithin, and the skirt including a skirt front wall and a skirt rear wall, and a plurality of support legs mounted to the table plate within the skirt, each of the support legs includes a first tube and a second tube telescopingly received within the first tube, and the first tube having a spherical head spaced from the second tube, and a support rod, the support rod including a pivot axle pivotally mounting the support rod to the table plate, and the support rod having a support rod free end and support rod threads, and the support rod further including a latch rod orthogonally oriented and directed into the support rod, wherein the latch rod includes a latch rod spring captured between the support rod and the latch rod biasing the latch rod in a projected relationship relative to the support rod, and the latch rod further including a latch rod abutment, and a latch rod aperture directed through the skirt in adjacency to the latch rod to receive the latch rod when the support rod is orthogonally oriented relative to the table plate, and the support rod free end further including a resilient friction pad and the spherical head arranged for engagement with the friction pad, and a lock sleeve threadedly directed about the support rod threads and the lock sleeve including a lock sleeve flange, and the spherical head captured between the lock sleeve flange and the friction pad, whereupon securement of the lock sleeve about the support rod secures the spherical head against the friction pad to maintain alignment of the first tube and the second tube relative to the support rod.

2. An apparatus as set forth in claim 1 including a pump, and a pump conduit directed from the pump to the faucet, and a fill conduit directed from the pump to a water supply, and a battery member, the battery member having battery cables directed from the battery member to an on/off switch, and the on/off switch directed in electrical communication with the pump to effect selective actuation of the pump to direct fluid through the fill conduit, the pump, and the pump conduit into the faucet through the faucet valve.

3. An apparatus as set forth in claim 2 including a slide drawer slidably directed through the front wall, the slide drawer having a slide drawer floor and a slide drawer front wall, wherein the slide drawer is arranged for a first position, with the slide drawer front wall in a coplanar relationship relative to the front wall to a second position wherein the slide drawer front wall is arranged in a spaced relationship relative to the skirt front wall, and wherein the floor includes a floor tunnel, wherein the floor tunnel is arranged in a colinearly aligned relationship relative to the first side wall opening and the second side wall opening when the slide drawer front wall is in the first position.

* * * * *